US009732931B2

(12) United States Patent
Sun et al.

(10) Patent No.: US 9,732,931 B2
(45) Date of Patent: Aug. 15, 2017

(54) LIGHT-EMITTING MODULE AND LIGHT-EMITTING DEVICE

(71) Applicant: PlayNitride Inc., Tainan (TW)

(72) Inventors: Sheng-Yuan Sun, Tainan (TW); Gwo-Jiun Sheu, Tainan (TW); Po-Jen Su, Tainan (TW)

(73) Assignee: PlayNitride Inc., Tainan (TW)

( * ) Notice: Subject to any disclaimer, the term of this patent is extended or adjusted under 35 U.S.C. 154(b) by 0 days.

(21) Appl. No.: 15/058,154

(22) Filed: Mar. 2, 2016

(65) Prior Publication Data

US 2016/0348872 A1 Dec. 1, 2016

(30) Foreign Application Priority Data

May 25, 2015 (TW) ..... 104116633 A

(51) Int. Cl.

| | |
|---|---|
| ***F21V 5/00*** | (2015.01) |
| ***F21V 13/04*** | (2006.01) |
| ***F21V 7/04*** | (2006.01) |
| ***F21V 5/04*** | (2006.01) |
| *F21Y 101/02* | (2006.01) |
| *F21Y 103/00* | (2016.01) |

(52) U.S. Cl.

CPC ..... *F21V 5/007* (2013.01); *F21V 5/04* (2013.01); *F21V 7/04* (2013.01); *F21V 13/04* (2013.01); *F21Y 2101/02* (2013.01); *F21Y 2101/025* (2013.01); *F21Y 2103/003* (2013.01)

(58) Field of Classification Search

USPC .... 362/23.14, 609, 623, 560, 514, 516, 517, 362/217.05, 241, 243, 245, 247, 296.01, 362/301, 302, 341, 169, 215, 268, 335, 362/455

See application file for complete search history.

(56) References Cited

U.S. PATENT DOCUMENTS 7,581,853 B2 9/2009 Kim et al.
2010/0320933 A1* 12/2010 Lai ..... F21S 9/037 315/294

(Continued)

FOREIGN PATENT DOCUMENTS

CN 101929647 12/2010
CN 104344346 * 2/2015

(Continued)

OTHER PUBLICATIONS

"Office Action of Taiwan Counterpart Application", dated Apr. 19, 2016, p. 1-p. 5.

*Primary Examiner* — Ashok Patel
(74) *Attorney, Agent, or Firm* — Jianq Chyun IP Office

(57) ABSTRACT

A light-emitting module that includes a light source and an optical lens is provided. The light source emits an original beam along a direction of a light-emitting axis, and the optical lens is disposed on a transmission path of the original beam. The original beam passes the optical lens and becomes an illumination beam. A light shape of the illumination beam has a first full width at half maximum (FWHM) along a first direction and has a second FWHM along a second direction, and a ratio of the second FWHM to the first FWHM is large than 3. The first direction and the second direction are perpendicular to the direction of the light-emitting axis. A light-emitting device is also provided.

15 Claims, 7 Drawing Sheets

(56) References Cited

U.S. PATENT DOCUMENTS

| | | | | |
|---|---|---|---|---|
| 2012/0300467 | A1 | 11/2012 | Chen | |
| 2015/0109762 | A1* | 4/2015 | Lee | G09F 13/04 362/97.1 |
| 2015/0276170 | A1* | 10/2015 | Motoyanagi | F21V 5/04 362/335 |
| 2016/0201876 | A1* | 7/2016 | Lv | F21V 5/008 362/268 |

FOREIGN PATENT DOCUMENTS

| | | |
|---|---|---|
| TW | M470029 | 1/2014 |
| TW | M499337 | 4/2015 |

* cited by examiner

LIGHT-EMITTING MODULE AND LIGHT-EMITTING DEVICE

CROSS-REFERENCE TO RELATED APPLICATION

This application claims the priority benefit of Taiwan application serial no. 104116633, filed on May 25, 2015. The entirety of the above-mentioned patent application is hereby incorporated by reference herein and made a part of this specification.

FIELD OF THE INVENTION

The invention relates to an optical module and an optical device. More particularly, the invention relates to a light-emitting module and a light-emitting device.

DESCRIPTION OF RELATED ART

With the development of science and technologies, light-emitting diodes (LEDs) characterized by high efficiency, long life span, and energy-saving ability based on environmental consciousness have gradually replaced the conventional mercury lamps and have been extensively applied as linear light sources in printing curing devices, medical devices, scanning devices, and so forth. Hence, how to develop an LED device capable of providing a satisfactory linear light source has become an important issue nowadays.

While the linear light sources are being employed, the focusing and collimating effects that can be achieved by the linear light source as well as the brightness of the linear light source are often the main concerns. At present, the conventional linear light sources are mostly formed by linearly arranging a plurality of LEDs. However, beams coming from the LEDs are often emitted at a relatively large divergence angle, and thus the resultant beams from the linear light sources are divergent, which reduces the collimation of the linear light sources. Besides, the mixed beams coming from the LEDs are not uniform, which leads to the reduction of the quality of the beams from the linear light sources.

SUMMARY OF THE INVENTION

The invention is directed to a light-emitting module, and light shape distributions of the beams from the light-emitting module are different in two directions.

The invention is also directed to a light-emitting device that can act as a satisfactory linear light source.

In an embodiment of the invention, a light-emitting module that includes a light source and an optical lens is provided. The light source emits an original beam along a direction of a light-emitting axis, and the optical lens is disposed on a transmission path of the original beam. The original beam passes the optical lens and becomes an illumination beam. A light shape of the illumination beam has a first full width at half maximum (FWHM) (e.g. a full width of angle at half maximum light intensity) along a first direction and has a second FWHM along a second direction, and a ratio of the second FWHM to the first FWHM is large than 3. The first direction and the second direction are perpendicular to the direction of the light-emitting axis.

According to an embodiment of the invention, the first FWHM is within a range from 20 degrees to 60 degrees, and the second FWHM is within a range from 100 degrees to 180 degrees.

According to an embodiment of the invention, the optical lens includes a light incident surface and a light output combination surface opposite to the light incident surface. The light output combination surface is axis-symmetrical along the first direction and the second direction.

According to an embodiment of the invention, the light output combination surface includes at least two first light output surfaces and at least two second light output surfaces, the at least two first light output surfaces are arranged along the first direction, and the at least two second light output surfaces are arranged along the second direction.

According to an embodiment of the invention, the at least two first light output surfaces and the at least two second light output surfaces constitute a plurality of boundary lines intersecting at a center of the light output combination surface.

According to an embodiment of the invention, a profile of the light output combination surface on a first plane is a first arc, and a profile of the light output combination surface on a second plane is a second arc. A normal vector of the first plane is parallel to the second direction, and a normal vector of the second plane is parallel to the first direction. An average curvature radius of the second arc is greater than an average curvature radius of the first arc.

In an embodiment of the invention, a light-emitting device that includes a lens module, a reflective mask, and a plurality of light sources disposed between the reflective mask and the lens module is provided. The light sources are arranged along a first direction, and each of the light sources emits an original beam along a direction of a light-emitting axis. The lens module is disposed on transmission paths of the original beams. Each of the original beams passes the lens module and becomes an illumination beam. A light shape of each of the illumination beams has a first FWHM along a first direction and has a second FWHM along a second direction, and a ratio of the second FWHM to the first FWHM is large than 3. The first direction and the second direction are perpendicular to the direction of the light-emitting axis. The reflective mask is configured to reflect one portion of the illumination beams toward the direction of the light-emitting axis, and the reflected portion of the illumination beams and another portion of the illumination beams are substantially transmitted along the direction of the light-emitting axis.

According to an embodiment of the invention, the lens module includes a plurality of optical lenses arranged along the first direction. Each of the optical lenses is located on the transmission path of one of the original beams, and the original beam passes a corresponding optical lens and becomes the illumination beam.

According to an embodiment of the invention, at least half of the illumination beams transmitted on a second plane are reflected by the reflective mask, the reflected portion of the illumination beams converges in the second direction, and a normal vector of the second plane is parallel to the first direction.

According to an embodiment of the invention, the reflective mask includes a reflective concave surface, and the lens module and the light sources are adjacent to a location of a focus of the reflective concave surface in the second direction.

In view of the above, the light-emitting module provided in an embodiment of the invention is able to emit the illumination beams whose light shape distributions are different in two directions through the optical lens. Here, the illumination beams can be reflected toward and transmitted along a direction in an effective manner. The beams emitted by the light-emitting device converge along one direction according to an embodiment of the invention, and therefore the light-emitting device described herein can serve as a satisfactory linear light source.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the invention.

FIG. 1A' and FIG. 1B' illustrate light shape distributions of the light-emitting module according to the first embodiment of the invention.

DETAILED DESCRIPTION OF DISCLOSED EMBODIMENTS

Figure 1A:
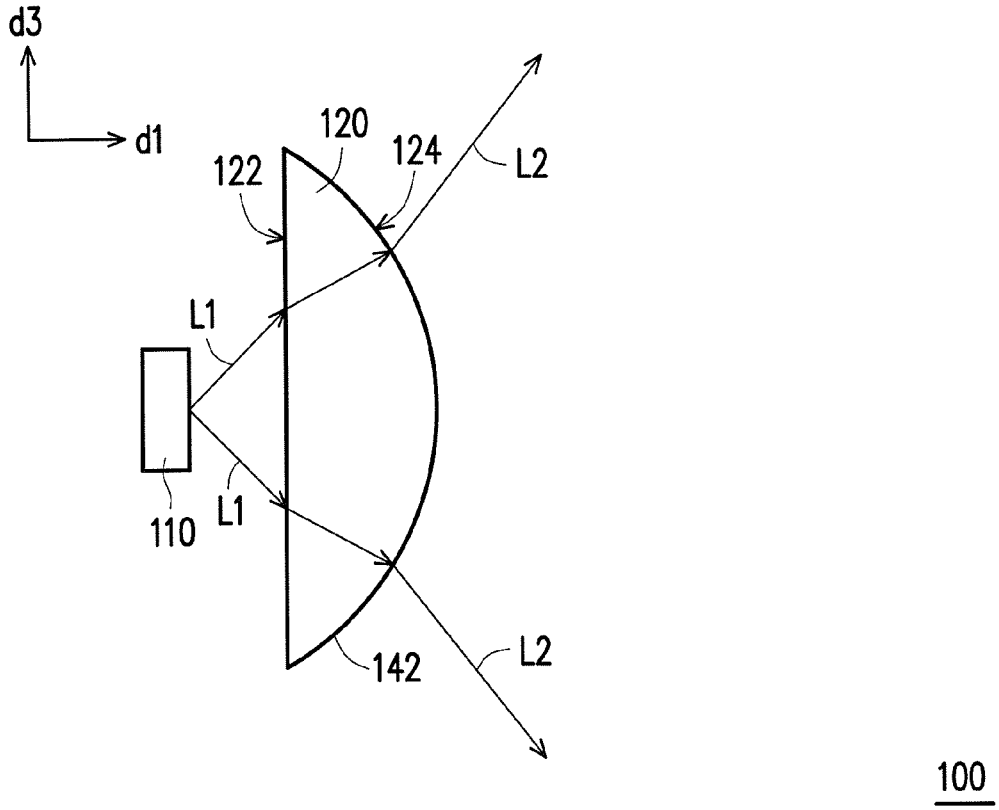
FIG. 1A and FIG. 1B are schematic views illustrating a light-emitting module according to a first embodiment of the invention.
Figure 1A:
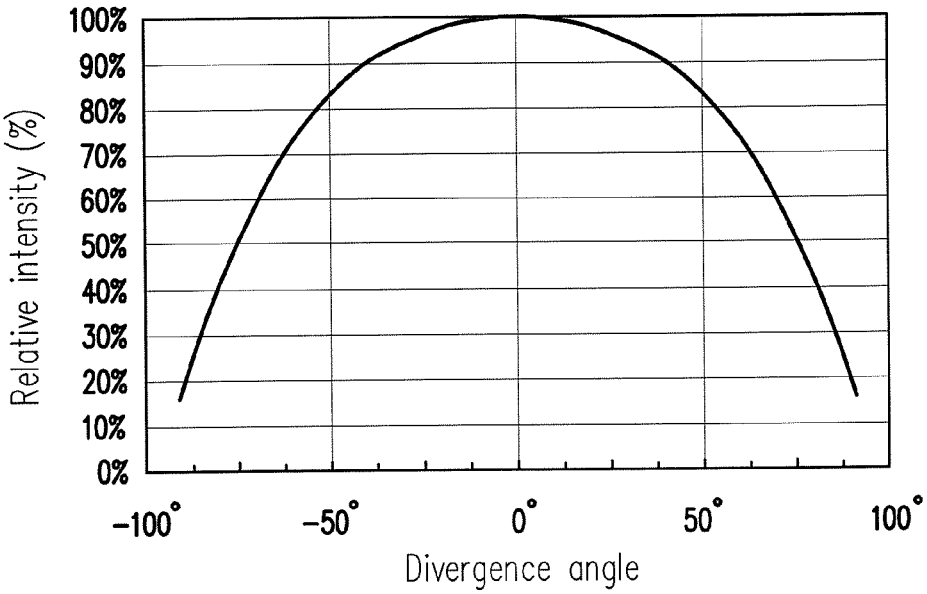
Figure 1B:
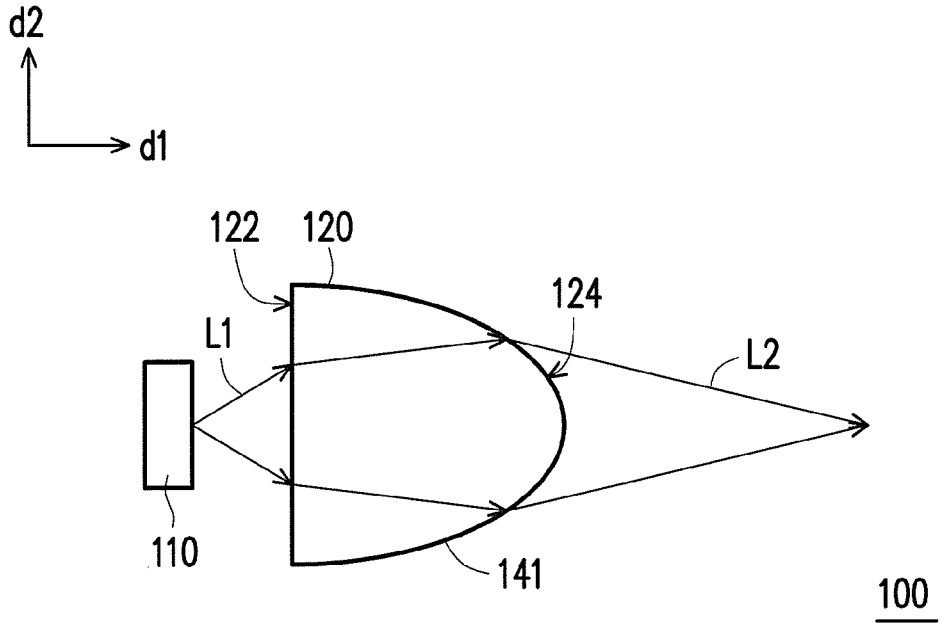
Figure 1B:
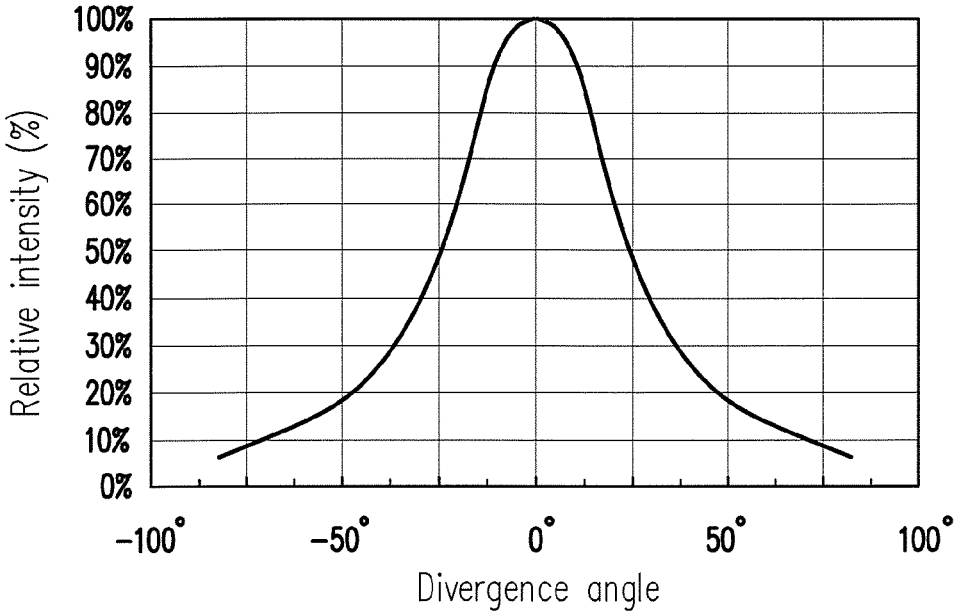

FIG. 1A and FIG. 1B are schematic views illustrating a light-emitting module according to a first embodiment of the invention. With reference to FIG. 1A and FIG. 1B, in the first embodiment of the invention, the light-emitting module 100 includes a light source 110 and an optical lens 120. The light source 110 emits an original beam L1 along a direction d1 of a light-emitting axis, and the optical lens 120 is disposed on a transmission path of the original beam L1. The original beam L1 passes through the optical lens 120 and becomes an illumination beam L2. Specifically, in order to clearly explain the light-emitting module provided in an embodiment of the invention, FIG. 1A is a schematic view illustrating the light-emitting module 100 along a first direction d2, so as to show the transmission path of the illumination beam L2 along a second direction d3; FIG. 1B is a schematic view illustrating the light-emitting module 100 along the second direction d3, so as to show the transmission path of the illumination beam L2 along the first direction d2. Both the first direction d2 and the second direction d3 are perpendicular to the direction d1 of the optical axis (i.e. the light-emitting axis). Specifically, the first direction d2 is perpendicular to the second direction d3.

FIG. 1A' and FIG. 1B' illustrate light shape distributions of a light-emitting module according to the first embodiment of the invention. With reference to FIG. 1A', the light shape of the illumination beam L2 has a second full width at half maximum (FWHM) along the second direction d3. With reference to FIG. 1B', the light shape of the illumination beam L2 has a first FWHM along the first direction d2. FIG. 1A' and FIG. 1B' show the corresponding relation between the light intensity and the divergence angle of the illumination beam L2. Here, the first FWHM is within a range from 20 degrees to 60 degrees, and the second FWHM is within a range from 100 degrees to 180 degrees. Particularly, the second FWHM of the illumination beam L2 in the second direction d3 is greater than the first FWHM of the illumination beam L2 in the first direction d2, and thus the illumination beam L2 diverges in the second direction d3 and converges in the first direction d2. Preferably, a ratio of the second FWHM to the first FWHM is large than 3. According to the present embodiment, the first FWHM of the illumination beam L2 in the first direction d2 is about 50 degrees, and the second FWHM of the illumination beam L2 in the second direction d3 is about 150 degrees. If the ratio of the FWHM of an illumination beam in two directions is less than 3, the difference of distribution ranges of the illumination beam in the two different directions is overly small, such that said convergence and divergence effects are not apparent. Specifically, in an embodiment of the invention, the ratio of the second FWHM to the first FWHM is preferably greater than 5, and thereby the difference of the distribution ranges of the light shape of the illumination beam L2 in the two different directions is apparent. As such, after a reflective element (not shown) is subsequently foamed, for instance, favorable optical effects can be accomplished. It should be mentioned that the original beam L1 can have a third FWHM which is less than the second FWHM and greater than the first FWHM; through the optical lens 120, the original beam L1 becomes the illumination beam L2 whose distribution range difference in the two different directions is apparent, and thereby the resultant effects can be more satisfactory.

In light of the foregoing, the light shape distributions of the illumination beam L2 from the light-emitting module 100 described herein are different in two different directions, and the ratio of the second FWHM to the first FWHM in the two directions is greater than 3; hence, the focusing effect achieved by the illumination beam L2 in the first direction d2 is more satisfactory than that accomplished by the original beam L1, and the divergence angle of the illumination beam L2 in the second direction d3 is greater than that of the original beam L1. Here, the light source 110 is an LED, a laser diode, or any other light-emitting device suitable for emitting beams. The original beam L1 is emitted from the light source 110 at a certain divergence angle. Through the optical lens 120 described in the present embodiment, the original beam L1 can become the illumination beam L2 whose distribution range in the first direction d2 and the second direction d3 is different. Besides, the illumination beam L2 in the second direction d3 can easily converge in the direction d1 of the light-emitting axis after the illumination beam L2 is reflected by a reflective element (not shown). In other words, the light-emitting module 100 provided herein can act as a linear light source capable of emitting lights with uniformity and achieving the favorable focusing effect after said reflection.

Figure 1C:
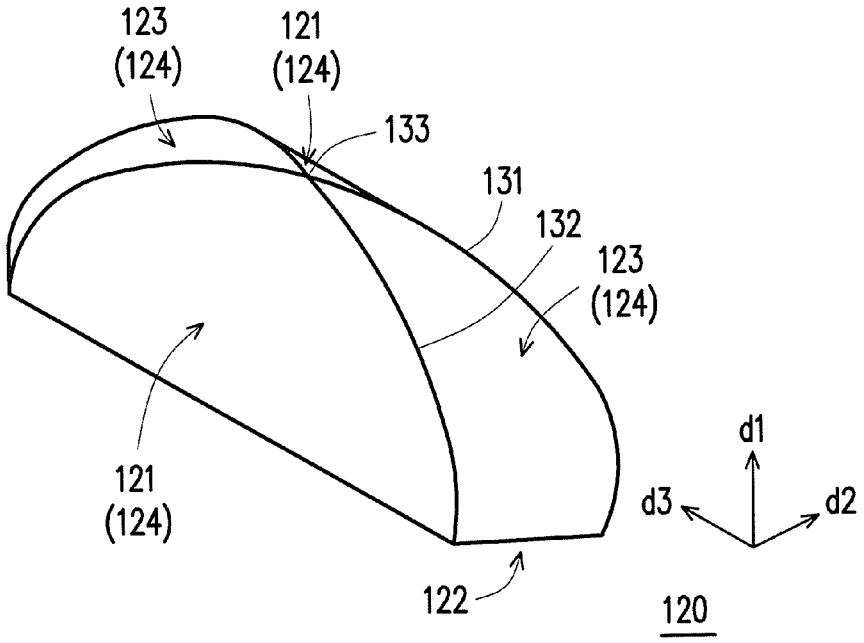
FIG. 1C is a schematic three-dimensional view illustrating an optical lens according to the first embodiment of the invention.
Figure 1D:
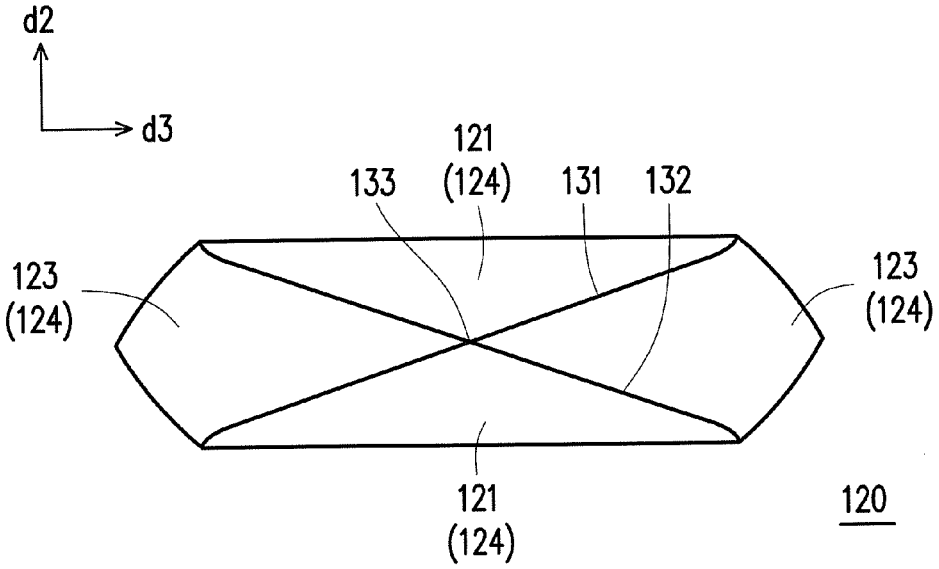
FIG. 1D is a top view illustrating the optical lens according to the first embodiment of the invention.
Figure 1E:
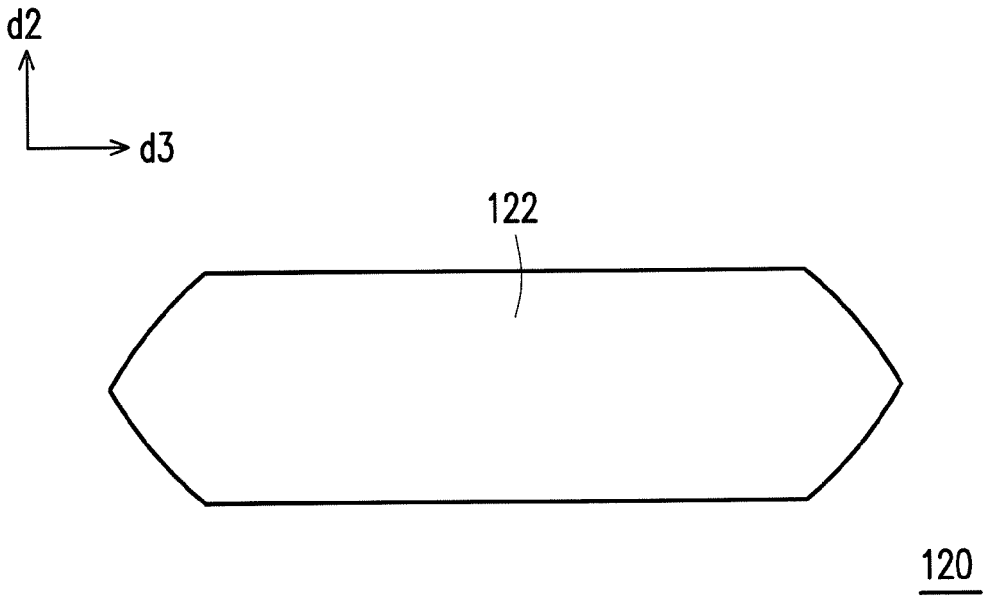
FIG. 1E is a bottom view illustrating the optical lens according to the first embodiment of the invention.

FIG. 1C is a schematic three-dimensional view illustrating an optical lens according to the first embodiment of the invention. FIG. 1D is a top view illustrating the optical lens according to the first embodiment of the invention. FIG. 1E is a bottom view illustrating the optical lens according to the first embodiment of the invention. With reference to FIG. 1C, FIG. 1D, and FIG. 1E, to be specific, the optical lens 120 includes a light incident surface 122 and a light output combination surface 124 opposite to the light incident surface 122. The light output combination surface 124 can be axis-symmetrical along the first direction d2 and the second direction d3. According to an embodiment of the invention, the light output combination surface 124 includes at least two first light output surfaces 121 and at least two second light output surfaces 123, the at least two first light output surfaces 121 are arranged along the first direction d2, and the at least two second light output surfaces 123 are arranged along the second direction d3. In two different directions, the first light output surfaces 121 and the second light output surfaces 123 are different curved surfaces. Therefore, in the original beam L1 emitted from the light source 110, one portion of the original beam L1 deviating along the first direction d2 substantially penetrates the first light output surfaces 121 while passing through the optical lens 120, and another portion of the original beam L1 deviating along the second direction d3 substantially penetrates the second light output surfaces 123 while passing through the optical lens 120. Here, a profile of the light output combination surface 124 on a first plane (i.e., the plane shown in FIG. 1B) whose normal vector is parallel to the second direction d3 is a first arc 141, and a profile of the light output combination surface 124 on a second plane (i.e., the plane shown in FIG. 1A) whose normal vector is parallel to the first direction d2 is a second arc 142. An average curvature radius of the second arc 142 is greater than an average curvature radius of the first arc 141; accordingly, the illumination beam L2 converted by the optical lens 120 can achieve different divergence and convergence effects. Namely, the illumination beam L2 converges along the first direction d2 and diverges along the second direction d3. In particular, the optical lens 120 is asymmetrical to the direction of the light-emitting axis. Superficially, the light incident surface 122 may be a plane (i.e., the plane shown in FIG. 1E) and may have accommodation space (not shown) to hold the light source 110; thereby, the volume of light-emitting module 100 can be further reduced.

The two first light output surfaces 121 and the two second light output surfaces 123 of the light output combination surface 124 described herein may be alternately arranged along the center 133 of the light output combination surface 124. Hence, the optical lens 120 allows the illumination beam L2 to accomplish different divergence and convergence effects in at least two different directions. Besides, in the present embodiment, the first light output surfaces 121 and the second light output surfaces 123 constitute boundary lines 131 and 132 intersecting at the center 133 of the light output combination surface 124; therefore, when the light source 110 is disposed corresponding to the center 133 of the optical lens 120, i.e., the light-emitting axis of the light source 110 passes the center 133 of the optical lens 120, the original beam L1 emitted toward the center 133 along the light-emitting axis d1 can be effectively deviated by the light output combination surface 124 to form the illumination beam L2 which can achieve different convergence and divergence effects in different directions.

Said arrangement of the first and second light output surfaces 121 and 123 of the light output combination surface 124 in the optical lens 120 is not limited to the embodiment provided herein; in another embodiment, the light output combination surface can be constituted by other numbers and types of light output surfaces surrounding the center of the light output combination surface. In another embodiment of the invention, the center of the light output combination surface can further has a light-emitting center surface, and peripheries of the light-emitting center surface are connected to different light-emitting surfaces that are bent. The invention is not limited thereto.

Figure 2A:
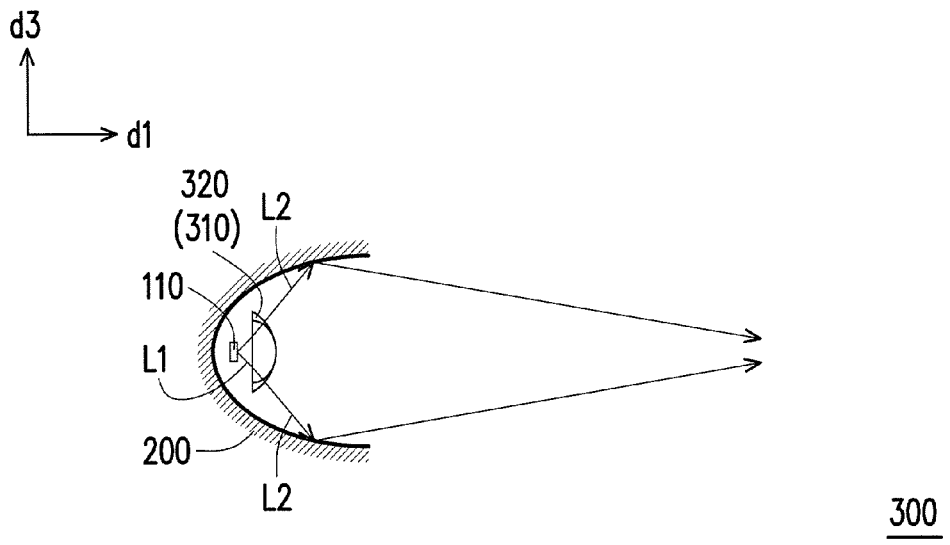
FIG. 2A, FIG. 2B, and FIG. 2C are schematic views illustrating an optical device according to a second embodiment of the invention.
Figure 2B:
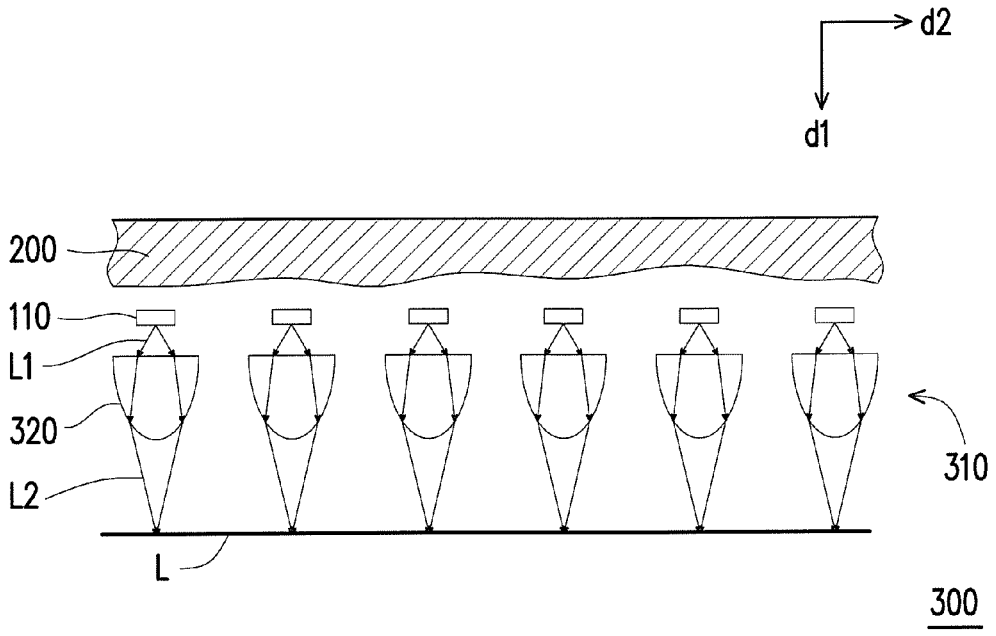
Figure 2C:
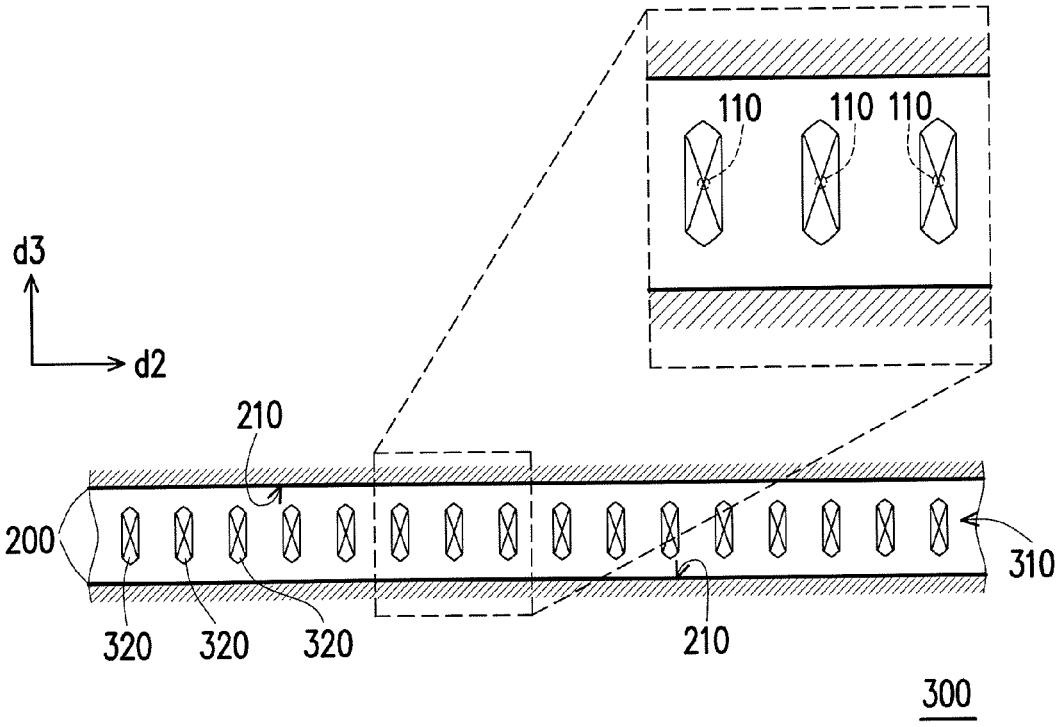

FIG. 2A, FIG. 2B, and FIG. 2C are schematic views illustrating an optical device according to a second embodiment of the invention. To clearly illustrate the light-emitting device 300 provided in the present embodiment, the light-emitting device 300 is depicted along the first direction d2 in FIG. 2A, along the second direction d3 in FIG. 2B, and along the direction d1 of the light-emitting axis in FIG. 2C. Besides, identical or similar reference numbers represent identical or similar elements, and repetitive descriptions are omitted. The omitted descriptions may be found in the previous exemplary embodiments.

With reference to FIG. 2A to FIG. 2C, in the second embodiment, the light-emitting device 300 includes a lens module 310, a reflective mask 200, and a plurality of light sources 110 disposed between the reflective mask 200 and the lens module 310. Each of the light sources 110 emits the original beam L1 along the direction d1 of the light-emitting axis. The lens module 310 is located on the transmission paths of the original beams L1 emitted from the light sources 110, and each of the original beams L1 passes the lens module 310 and becomes the illumination beam L2.

As shown in the partial enlarged view in FIG. 2C, the light sources 110 are arranged along the first direction d2, the light shape of each of the illumination beams L2 passing through the lens module 310 has a first FWHM along the first direction d2 perpendicular to the direction d1 of the light-emitting axis and has a second FWHM along the second direction d3 perpendicular to the direction d1 of the light-emitting axis, and a ratio of the second FWHM to the first FWHM is large than 3. That is, most of the illumination beams L2 passing through the lens module 310 provided in the present embodiment converge in the first direction d2 and diverge in the second direction d3, as shown in FIG. 2A and FIG. 2B. The reflective mask 200 is configured to reflect one portion of the illumination beams L2 diverging in the second direction d3 toward the direction d1 of the light-emitting axis, and the reflected portion of the illumination beams L2 and another portion of the illumination beams L2 converging in the first direction d2 are substantially transmitted along the direction d1 of the light-emitting axis. That is, the reflective mask 200 reflects the portion of the illumination beams L2 diverging in the second direction d3 toward the direction d1 of the light-emitting axis and allows the reflected portion of the illumination beams L2 and the other portion of the illumination beams L2 converging in the first direction d2 to gather in one area in a uniform manner, so as to create a linear light source L extending along the first direction d2. In order to clearly illustrate the locations and the connection relationship of the elements provided in the present embodiment, note that the FIG. 2A to FIG. 2C are enlarged views, and these views should not be construed as limitations to the dimensions and the locations of the elements provided herein. Based on such design, the linear light source L capable of emitting uniform beams can be formed.

Preferably, with reference to FIG. 2A and FIG. 2C, in the present embodiment, at least half of the illumination beams L2 transmitted on a second plane (whose normal vector is parallel to the first direction d2) are reflected by the reflective mask 200, the reflected portion of the illumination beams L2 converges along the second direction d3, and the reflected portion of the illumination beams L2 and another portion of the illumination beams L2 converging along the first direction d2 gather at the same area in a uniform manner, so as to form the linear light source L extending along the first direction d2. As such, the light-emitting device 300 provided in the present embodiment can emit the illumination beams L2 that can achieve the favorable focusing effect.

Specifically, as shown in FIG. 2C, the reflective mask 200 described in the present embodiment includes a reflective concave surface 210, and the lens module 310 includes a plurality of optical lens 320 arranged along the first direction d2. Each of the optical lenses 320 is located on the transmission path of one of the original beams L1, and the original beams L1 passes a corresponding optical lens 320 and becomes the illumination beam L2. The lens module 310 and the light sources 110 are located in the recess area constituted by the reflective concave surface 210. Since the optical lenses 320 in the lens module 310 provided in the present embodiment are similar to the optical lens 120 provided in the previous embodiment, the illumination beams L2 that are emitted from the light sources 110 and pass through the lens module 310 are reflected by the reflective concave surface 210 in the second direction d3, such that the beams emitted by the light-emitting device 300 can all accomplish the satisfactory focusing effect. In particular, for instance, the reflective concave surface 210 is an elliptic reflective surface, and the lens module 310 and the light sources 110 are located on a focus of the cross-section of the elliptic reflective surface, such that the reflected illumination beams L2 can achieve the favorable focusing effect; however, the invention is not limited thereto. In another embodiment of the invention, the lens module 310 and the light sources 110 may be adjacent to the location of the focus of the elliptic reflective surface according to actual demands.

In other words, each of the illumination beams L2 emitted from the light-emitting device 300 in the present embodiment converges along the first direction d2, and the illumination beams L2 along the second direction d3 also converge in the second direction d3 after the illumination beams L2 are reflected by the reflective mask 200. Hence, the illumination beams L2 gather at the same area in a uniform manner. From another perspective, the optical lenses 320 in the lens module 310 may be closely arranged; together with the closely arranged light sources 110, the light-emitting device 300 provided in the present embodiment can serve as a linear light source because these beams that are emitted from the closely arranged light sources 110 and pass through the closely arranged optical lenses 320 can be added up in the first direction d2 in a uniform manner. Since the light-emitting device 300 provided in the present embodiment can act as the linear light source emitting uniform beams that achieve the favorable focusing effect, the light-emitting device 300 is rather applicable in the ultraviolet curing field that requires beams for achieving the favorable focusing effect and having uniform intensities. The conventional light-emitting device emits diverged beams which cannot evenly converge in the same direction even though these diverged beams are reflected by the reflective mask. By contrast, the illumination beams L2 emitted from the light-emitting device 300 provided herein not only accomplish the favorable focusing effect but also have uniform intensities in the first direction d2.

Figure 3:
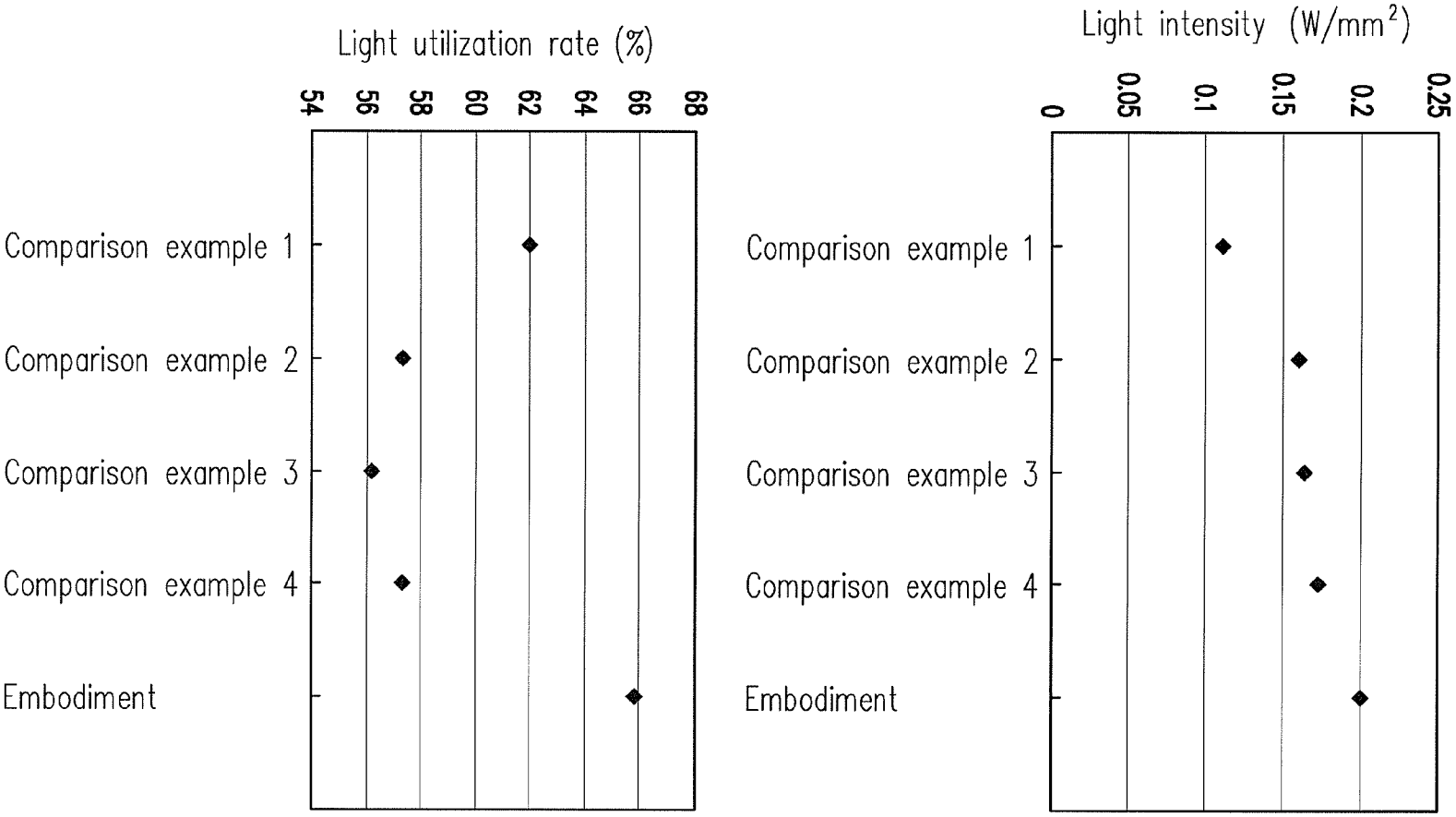
FIG. 3 schematically illustrates light intensity and light utilization rate in Table 1 according to an embodiment of the invention and some comparison examples.

The optical effects achieved in an embodiment of the invention and in other comparison examples are further explained hereinafter. Table 1 shows experimental data obtained through comparison between the illumination beams emitted from the light-emitting module described in an embodiment of the invention and reflected by the reflective mask and the illumination beams emitted from light-emitting modules provided in other comparison examples and reflected by a reflective mask. Here, the light-emitting module in the comparison example 1 has the 60-degree FWHM, the light-emitting module in the comparison example 2 has the Lambertian light shape, the light-emitting module in the comparison example 3 has the 145-degree FWHM, and the light-emitting module in the comparison example 4 has the Batwing light shape, for instance. FIG. 3 schematically illustrates light intensity and light utilization rate in Table 1 according to an embodiment of the invention and the comparison examples. With reference to FIG. 3 and Table 1, according to the data recorded in Table 1, the light utilization rate is the percentage

TABLE 1

Experimental data comparison table showing the comparison between the illumination beams emitted from the light-emitting module described in an embodiment of the invention and reflected by the reflective mask and the illumination beams emitted from light-emitting modules provided in other comparison examples and reflected by a reflective mask.

| | Comparison Example 1 | Comparison Example 2 | Comparison Example 3 | Comparison Example 4 | Embodiment |
|---|---|---|---|---|---|
| Light intensity ($W/mm^2$) | 0.112 | 0.161 | 0.164 | 0.172 | 0.201 |
| Light utilization rate (%) | 61.9 | 57.3 | 56.2 | 57.3 | 65.8 |

To sum up, in the light-emitting module provided in an embodiment of the invention, the optical lens converts the original beams emitted by the light sources to the illumination beams with different light shape distributions in two different directions. After the illumination beams in one direction are converged by the optical lens, the illumination beams can achieve the favorable focusing effect. In addition, the illumination beams diverging in another direction can be reflected by a reflective element and can then easily become converged beams. The illumination beams emitted by the light-emitting device converge along one direction and achieve the favorable focusing effect according to an embodiment of the invention, and therefore the light-emitting device described herein can serve as a satisfactory linear light source.

Although the invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

What is claimed is:

1. A light-emitting module comprising:

a light source emitting an original beam along a direction of a light-emitting axis; and an optical lens disposed on a transmission path of the original beam, the original beam passing the optical lens and becoming an illumination beam, wherein a light shape of the illumination beam has a first full width at half maximum along a first direction and has a second full width at half maximum along a second direction, a ratio of the second full width at half maximum to the first full width at half maximum is large than 3, and the first direction and the second direction are perpendicular to the direction of the light-emitting axis, wherein a numerator of the ratio is the second full width at half maximum, and a denominator of the ratio is the first full width at half maximum.

2. The light-emitting module of claim 1, wherein the first full width at half maximum is within a range from 20 degrees to 60 degrees, and the second full width at half maximum is within a range from 100 degrees to 180 degrees.

3. The light-emitting module of claim 1, wherein the optical lens comprises a light incident surface and a light output combination surface opposite to the light incident surface, and the light output combination surface is axis-symmetrical along the first direction and the second direction.

4. The light-emitting module of claim 1, wherein the light output combination surface comprises at least two first light output surfaces and at least two second light output surfaces, the at least two first light output surfaces are arranged along the first direction, and the at least two second light output surfaces are arranged along the second direction.

5. The light-emitting module of claim 4, wherein the at least two first light output surfaces and the at least two second light output surfaces constitute a plurality of boundary lines intersecting at a center of the light output combination surface.

6. The light-emitting module of claim 3, wherein a profile of the light output combination surface on a first plane is a first arc, a profile of the light output combination surface on a second plane is a second arc, a normal vector of the first plane is parallel to the second direction, a normal vector of the second plane is parallel to the first direction, and an average curvature radius of the second arc is greater than an average curvature radius of the first arc.

7. A light-emitting device comprising:

a plurality of light sources arranged along a first direction, each of the light sources emitting an original beam along a direction of a light-emitting axis;

a lens module disposed on transmission paths of the original beams, each of the original beams passing the lens module and becoming an illumination beam, wherein a light shape of each of the illumination beams has a first full width at half maximum along the first direction and has a second full width at half maximum along the second direction, a ratio of the second full width at half maximum to the first full width at half maximum is large than 3, and the first direction and the second direction are perpendicular to the direction of the light-emitting axis, wherein a numerator of the ratio is the second full width at half maximum, and a denominator of the ratio is the first full width at half maximum; and a reflective mask, wherein the light sources are disposed between the reflective mask and the lens module, the reflective mask is configured to reflect one portion of the illumination beams toward the direction of the light-emitting axis, and the reflected portion of the illumination beams and another portion of the illumination beams are substantially transmitted along the direction of the light-emitting axis.

8. The light-emitting device of claim 7, wherein the first full width at half maximum is within a range from 20 degrees to 60 degrees, and the second full width at half maximum is within a range from 100 degrees to 180 degrees.

9. The light-emitting device of claim 7, wherein the lens module comprises a plurality of optical lenses, each of the optical lenses is located on the transmission path of one of the original beams, the original beam passes the corresponding optical lens and becomes the illumination beam, and the optical lenses are arranged along the first direction.

10. The light-emitting device of claim 9, wherein the optical lens comprises a light incident surface and a light output combination surface opposite to the light incident surface, and the light output combination surface is axis-symmetrical along the first direction and the second direction.

11. The light-emitting device of claim 10, wherein the light output combination surface comprises at least two first light output surfaces and at least two second light output surfaces, the at least two first light output surfaces are arranged along the first direction, and the at least two second light output surfaces are arranged along the second direction.

12. The light-emitting device of claim 11, wherein the at least two first light output surfaces and the at least two second light output surfaces constitute a plurality of boundary lines intersecting at a center of the light output combination surface.

13. The light-emitting device of claim 10, wherein a profile of the light output combination surface on a first plane is a first arc, a profile of the light output combination surface on a second plane is a second arc, a normal vector of the first plane is parallel to the second direction, a normal vector of the second plane is parallel to the first direction, and an average curvature radius of the second arc is greater than an average curvature radius of the first arc.

14. The light-emitting device of claim 7, wherein at least half of the illumination beams transmitted on a second plane are reflected by the reflective mask, the reflected portion of the illumination beams converges in the second direction, and a no al vector of the second plane is parallel to the first direction.

15. The light-emitting device of claim 7, wherein the reflective mask comprises a reflective concave surface, and the lens module and the light sources are adjacent to a location of a focus of the reflective concave surface in the second direction.

* * * * *